US007901150B2

(12) United States Patent
Liberman et al.

(10) Patent No.: US 7,901,150 B2
(45) Date of Patent: Mar. 8, 2011

(54) DUAL MODE PRINTER

(75) Inventors: Boris Liberman, Herzliah (IL); Gur Shapira, Zoran (IL)

(73) Assignee: Matan Digital Printers Ltd., Rosh Ha'Ayin (IL)

( * ) Notice: Subject to any disclaimer, the term of this patent is extended or adjusted under 35 U.S.C. 154(b) by 977 days.

(21) Appl. No.: 11/693,449

(22) Filed: Mar. 29, 2007

(65) Prior Publication Data

US 2008/0143032 A1 Jun. 19, 2008

(30) Foreign Application Priority Data

Dec. 17, 2006 (IL) ..... 180111

(51) Int. Cl.
*B41J 2/01* (2006.01)
*B41J 11/00* (2006.01)

(52) U.S. Cl. ..... 400/55; 347/104; 400/56

(58) Field of Classification Search ..... 347/104; *B41J 2/01, 11/00*
See application file for complete search history.

(56) References Cited

U.S. PATENT DOCUMENTS

| | | | | | |
|---|---|---|---|---|---|
| 4,343,555 | A * | 8/1982 | Abbott | 400/144.2 |
| 4,552,354 | A * | 11/1985 | Kokubo et al. | 271/163 |
| 4,620,807 | A * | 11/1986 | Polit | 400/56 |
| 4,815,252 | A * | 3/1989 | Renard et al. | 53/383.1 |
| 5,080,344 | A * | 1/1992 | Hayashi | 271/107 |
| 6,296,403 | B1 | 10/2001 | Duchovne | |
| 6,675,707 | B1 * | 1/2004 | Heiler et al. | 101/216 |
| 6,883,987 | B2 * | 4/2005 | Kamin et al. | 400/605 |
| 7,429,042 | B2 * | 9/2008 | Ban et al. | 271/274 |
| 2004/0017456 | A1 * | 1/2004 | Obertegger et al. | 347/104 |

FOREIGN PATENT DOCUMENTS

| | | | |
|---|---|---|---|
| JP | 55040139 | A * | 3/1980 |
| JP | 2003094744 | A * | 4/2003 |
| JP | 2005067105 | A * | 3/2005 |
| RU | 2167063 | | 5/2001 |
| WO | WO2004037543 | | 5/2004 |
| WO | WO2005074519 | | 8/2005 |

* cited by examiner

*Primary Examiner* — Judy Nguyen
*Assistant Examiner* — 'Wyn' Q Ha
(74) *Attorney, Agent, or Firm* — Kelleher Patent Law; Sean Liam Kelleher

(57) ABSTRACT

A wide/super wide digital printer comprising a printer head box that reciprocates from left to right across a wide or super wide printing table having a length of up to 20 cm that is supported by a fixed support, and a feed roller and a guiding roller that are moveably coupled to the fixed support, wherein the wide/super wide digital printer is configurable as a roll to roll printer by lowering the feed roller and the guiding roller to a lowered configuration wherein uppermost parts of the feed roller and the guiding roller are below upper surface of printing table, or as a discontinuous sheet printer by raising the feed roller and the guiding roller to a raised configuration wherein the uppermost parts of the feed roller and the guiding roller are collinear with the upper surface of the printing table.

13 Claims, 8 Drawing Sheets

DUAL MODE PRINTER

BACKGROUND OF THE INVENTION

1. Field of the Invention

The present invention is directed to providing a printer; specifically a wide format digital printer that is capable of printing onto both roll stock and onto single sheets of discontinuous substrate and to providing a novel mechanism for moving the feed rollers of the printer to facilitate quality printing on both types of substrate.

2. Brief Description of the Art

Digital printing is widely used for printing posters, wall decorations, signs and the like. The material to be printed, if flexible, is typically provided on a continuous roll and is advanced roll to roll past the print head. Sometimes however, particularly when printing onto a rigid material, the material to be printed is provided in sheet form and the printing technique is then known as flat bed printing. The wider the sheet, the greater the tendency for it to be warped or misaligned whilst being fed past the printer head, and with wide/super wide printing, here the print are is 3 m wide or more, flat bed printing is only suitable or printing onto rigid substrates.

In all printing technologies advancing systems are required to accurately position the material to be printed with respect to the printing head. Even a small deviation from the correct positioning results in noticeable printing defects.

To save space and equipment costs, it is useful for a single machine to be able to operate as both a flat bed printer and as a roll to roll printer. The wider the material to be printed, the more difficult it is to obtain alignment, and providing a single printer, capable of both flat bed and roll to roll printing, though desirable, is not easily achieved.

WO04037543 to Nur Macroprinters LTD., titled "Advancing System and Method for a Digital Printing Apparatus", describes a printer apparatus comprising a printing head system and an advancing system. The printing head includes a print head assembly mounted for movement along at least one horizontal axis with respect to a printing area. The advancing system is configured and operable for enabling to selectively locate the printing area in either one of a first or a second printing plane arranged in vertically spaced-apart relationship, thereby selectively exposing the first or second printing plane to the print head assembly for printing. The first and second printing planes are defined by, respectively, a first flat-bed assembly and a second roll-to-roll assembly of the advancing system.

Nur Macroprinter's solution requires moving the printer head from one printing plane to another. In each printing mode the printer head moves over a relatively long table in two directions. The two printing modes use different printing tables. Moving from one printing mode to another in this manner is likely to be time consuming. Furthermore, since the printer head may be moved in three directions with respect to the substrate to be printed, it is not easy to ensure accurate, repeatable alignment, particularly when moving from one printing type to the other. Because two printing tables are used, both require calibrating to attain planarity in a parallel plane to the movement of the printer head, and this is not easily achieved since the printing tables have a tendency to warp. Indeed movement of the printing table is best avoided.

U.S. Pat. No. 6,296,403 to Scitex Vision describes a dual-mode printer for printing on both flexible and rigid substrates that includes a table for providing a substantially planar support surface for supporting a substrate thereupon. A flexible-substrate feed system is configured to feed a flexible substrate in a given feed direction across the support surface. The printer has a print head configured for depositing a printing medium on a substrate as part of a printing process. A motion system is configured to generate relative displacement between the print head and the support surface in at least a first direction parallel to the feed direction. This combination of components allows the printer to be used in both: (i) a flexible-substrate mode in which relative displacement between the substrate and the print head is generated at least in part by the flexible-substrate feed system, and (ii) in a rigid-substrate mode in which relative displacement between the substrate and the print head is generated exclusively by the motion system.

The printing table of the dual mode printer used is a long table suitable for flat bed printing. Such a table is inherently unsuitable for roll-to-roll printing since the distance between the rollers is large, and the flexible substrate to be printed is likely to assume a wavy surface which adversely affects the resolution of the printing thereon.

Russian Patent Number RU 2167063 relates to a method of printing wherein the substrate to be printed is fed roll to roll and the table moves as well.

WO05074519 to L & P Property Management Company describes an apparatus and a method of ink jet printing that use a system for feeding a substrate longitudinally relative to a support area, and a system for moving a print head parallel to the direction of the substrate feed. Indexing between transverse scan rows of a print head is carried out initially by the substrate feed system and the actual feed distance is measured using an encoder or other substrate position measurement device. A controller determines the amount of any error that occurs between the actual and the desired feed distances. The controller then sends signals to move the print head to compensate for any error in the feeding of the feed system. Compensating adjustments are then made to the next subsequent substrate indexing step so that the print head tends to move back toward its home or zeroed position with its next correction and does not walk away from this home position as a result of cumulative movements. For printers that have bridges that are moveable relative to the machine frame on which the print head is carried, print head motion is achieved by moving the bridge, for example, by actuating a linear servo bridge motion system. For fixed bridge roll-to-roll printers, the print head can be caused to shift longitudinally on the bridge to make the correcting movements.

The controller for controlling the amount of error and the compensation thereof indicate the problems in obtaining accurate positioning where the bridgehead moves relative to the support area, the support area moves relative to the material to be printed, and the material to be printed is fed as well.

Thus, despite the developments described above, there is a need for a simple, reliable printing machine that is capable of accurately printing onto continuous substrate roll-to-roll in a first mode, or onto single sheets in a second mode, where conversion of the machine from one mode to the other is relatively easy, and the present invention addresses this need.

SUMMARY OF THE INVENTION

In a first aspect, the present invention is directed to providing a system for raising and lowering a pair of rollers between a raised configuration and a lowered configuration with respect to a fixed support, comprising mounting each of said pair of rollers on a spindle fixed to a rocker plate on each end, each rocker plate being movable about an axle fixed to the fixed support, the moving of each rocker between a first position and a second position being driven by a driving means, and the first and second positions being determined by peg in slot mechanisms, wherein each rocker comprises a slot therethrough through which a peg fixed to the fixed support passes, and each rocker can be moved from a first position where the peg contacts the upper edge of the slot and a lower position where the peg contacts the lower edge of the slot.

In a preferred embodiment, the pair of rollers comprises a feed roller and a guiding roller of a digital printer, such that in the raised configuration, the feed roller and guiding roller are brought into alignment with a surface of a printing table and a rigid laminar substrate may be printed in a flat bed print mode by a printer head that travels from side to side across the digital printer over the printing table, whereas in the lowered configuration, the feed roller and guiding roller are positioned below the printing table and a flexible substrate may be printed in a roll to roll configuration.

Typically the feed roller is coated with a high friction rubbery surface.

Typically the digital printer is a wide or super-wide digital printer having an effective printing width of at least 2.5 m.

Typically the digital printer is a wide or super-wide digital printer having an effective printing width of up to 10 m.

Typically the driving means is selected from the list of pneumatic pistons, hydraulic pistons and worms, motors, springs and the like.

The printer table may be a short printer table having a length of not more than 15% of effective printing width.

Typically the printer table is less than 20 cm long.

Preferably the feed roller is advanced by a motor that is in fixed alignment with the spindle of the feed roller such that the motor moves up and down with the feed roller as the feed roller is moved between its upper and lower positions.

Typically the raising and lowering of the pair of rollers between the raised configuration and the lowered configuration with respect to the fixed support takes less than five minutes.

Preferably the raising and lowering of the pair of rollers between the raised configuration and the lowered configuration with respect to the fixed support is actuated by a switch and takes less than one minute.

In a second aspect, the present invention is directed to providing a wide/super wide digital printer comprising a printer head box that reciprocates from left to right across a wide or super wide printing table having a length of less than 20 cm that is supported by a fixed support, and a feed roller and guiding roller that are moveably coupled to the fixed support, wherein the wide/super wide digital printer is configurable as a roll to roll printer by lowering the feed roller and guiding roller to a lowered configuration, or, as a discontinuous sheet printer by raising the feed roller and guiding roller to a raised configuration that is collinear with the printing table.

Preferably the printable width of the wide/super wide digital printer is at least 2.5 m wide.

More preferably, the printable width of the wide/super wide digital printer is at least 3 m wide.

Typically the table length of the wide/super wide digital printer is no more than 15% of printable width.

In preferred embodiments, the wide/super wide digital printer further comprises a system for raising and lowering the feed roller and guiding roller between the raised configuration and the lowered configuration with respect to the fixed support; the system comprising a first spindle mount through the feed roller that is coupled to a first rocker plate at one end and a second rocker plate at other end, and a second spindle mount through the guiding roller that is coupled to a third rocker plate at one end and a fourth rocker plate at other end; each of said rockers being movable about an axle fixed to the fixed support, the moving of each rocker between a first position and a second position being driven by a driving means, and the first and second positions being determined by peg in slot mechanisms, wherein each rocker comprises a slot therethrough, through which a peg fixed to the fixed support passes, and each rocker can be moved from a first position where the peg contacts the upper edge of the slot and a lower position where the peg contacts the lower edge of the slot.

The term substrate as used herein refers to any flat medium that is printed on, including, inter alia, paper, fabric, card, boards of various types, and the like.

BRIEF DESCRIPTION OF THE SEVERAL VIEWS OF THE DRAWINGS

For a better understanding of the invention and to show how it may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawings making apparent to those skilled in the art how the several forms of the invention may be embodied in practice.

In the accompanying drawings:

FIG. 1 is a schematic cross-section through a prior art roll-to-roll wide or super-wide inkjet printing system showing the feed roller, guiding roller and printing table thereof;

FIG. 2 is a schematic isometric projection of the tensioning system of FIG. 1, showing the wide/super-wide substrate in tension by means of the relatively short printing table being raised slightly above the plane of the feed roller and guiding roller;

FIG. 3 is a schematic isometric projection of a prior art flat bed printing system with a vacuum table suitable for wide or super wide flat-bed printing wherein the table advances the substrate past the printing head;

FIG. 4 is a schematic isometric projection of a prior art flat bed printing system wherein the printer head advances over the substrate to be printed;

FIG. 5 is a schematic cross section of the double configuration feed roller system of the present invention, configured for roll to roll printing;

FIG. 6 is a schematic cross section of the double configuration feed roller system of the present invention, configured for printing onto discontinuous and typically rigid substrates;

FIG. 7 is an isometric projection of the drive system for interchanging between the configuration of FIG. 5 and the configuration of FIG. 6, and FIG. 8 is a schematic cross section of the double configuration feed roller system of the present invention, configured for printing onto a rigid substrate with roller tables positioned adjacent to the printer.

DESCRIPTION OF THE PREFERRED EMBODIMENTS

The present invention relates to a digital inkjet printer that can print onto material fed by two separate feed modes: either onto a continuous sheet material fed by a roll to roll system, or, onto discontinuous sheets, previously requiring flat bed printers.

Specifically, to allowing printing onto a discontinuous laminar substrate, such as cardboard and the like, the upper rollers, i.e. the feed and guide rollers of the roll to roll system can be raised to the height of the printing table, and guide wheels can be lowered to apply a pressure onto the upper surface of the laminar substrate to keep it pressed onto the feed roller.

Since the direction of travel of the printer head is generally referred to as from side to side, and printing as described herein is generally referred to as being wide or super-wide printing, the direction perpendicular to the length of the rollers is known herein as the length, despite it being appreciated that with regards to the following description and contrary to common usage, the term width relates to the longer direction.

Figure 1:
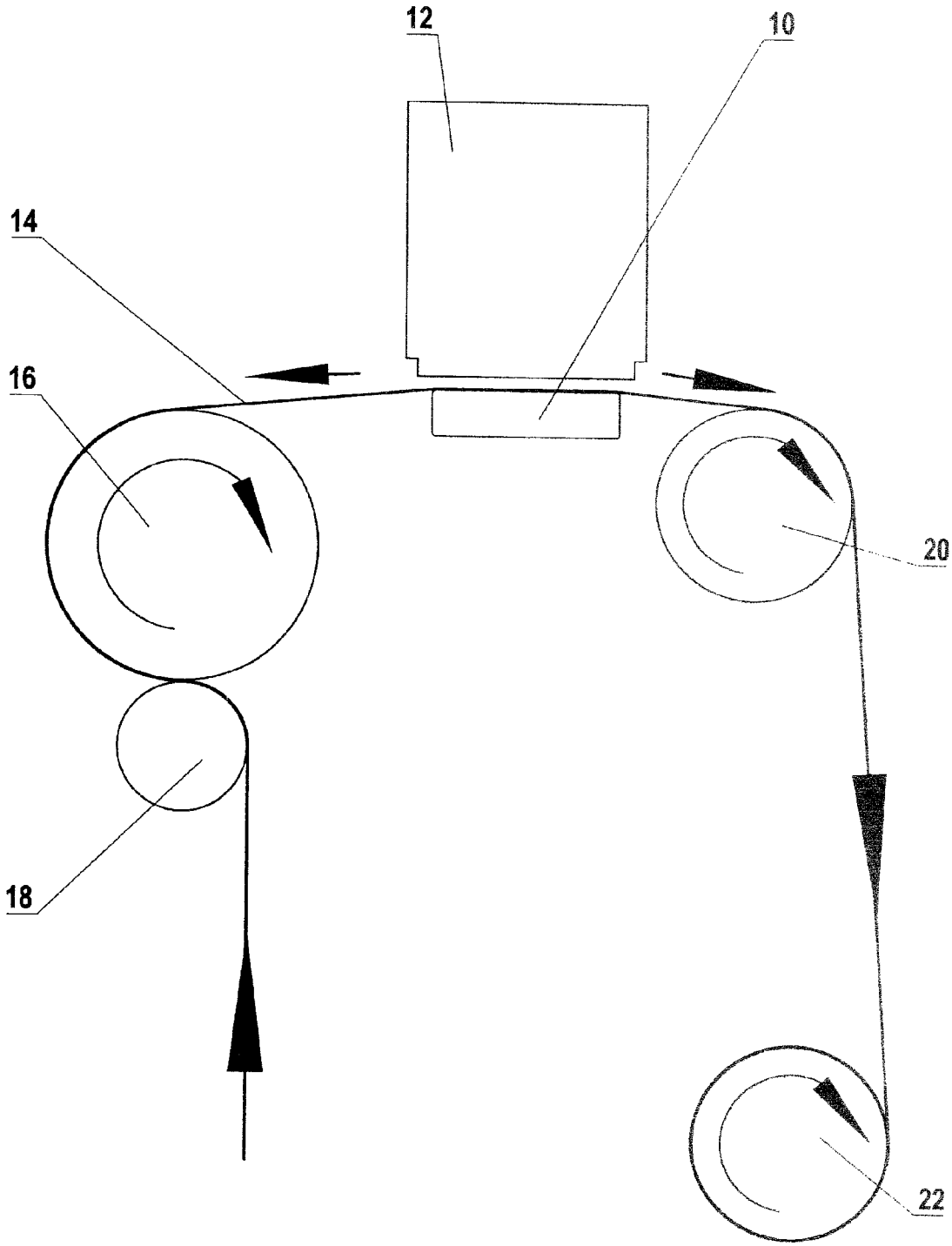
(PRIOR ART) FIG. 1
Figure 2:
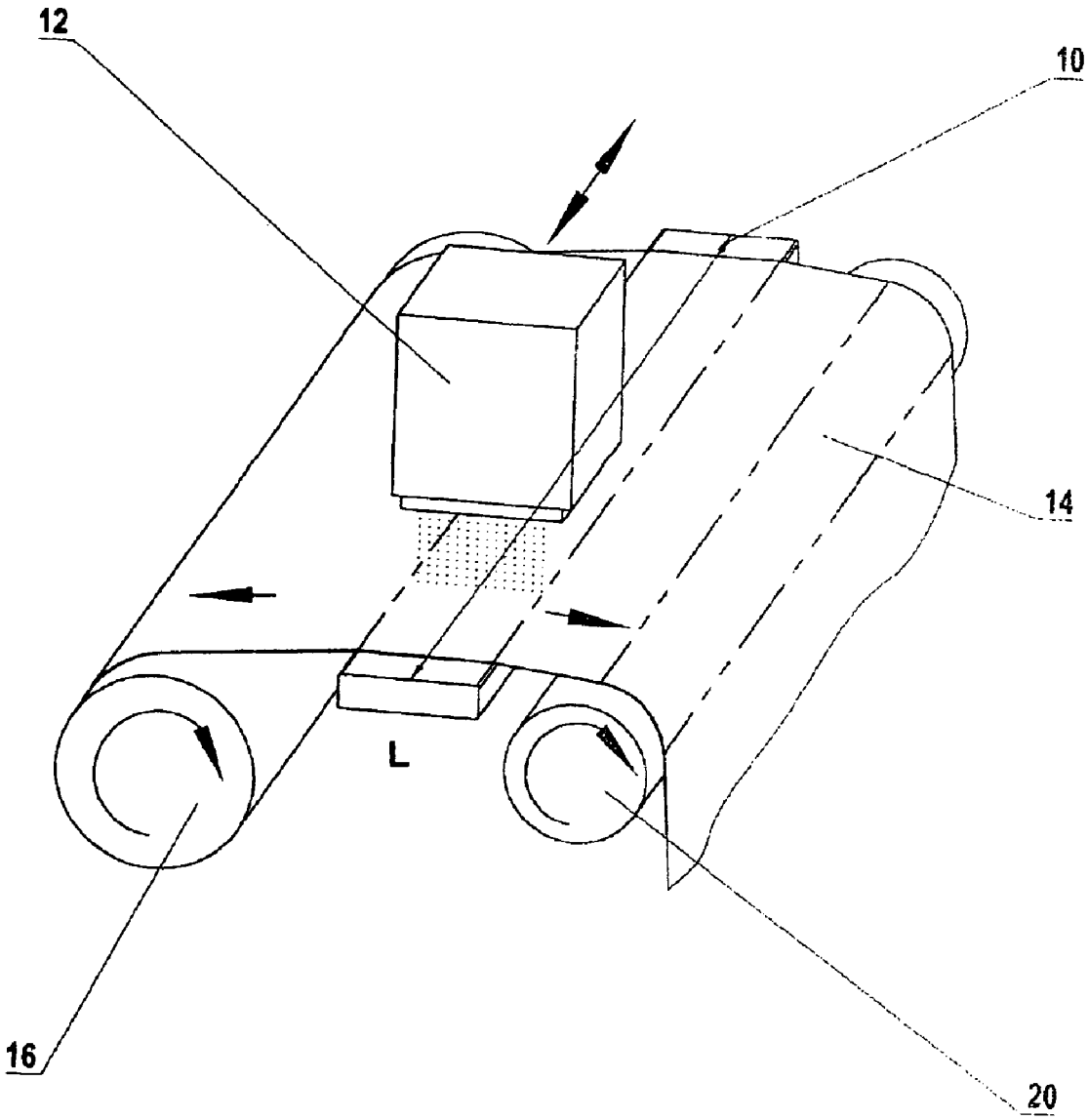
(PRIOR ART) FIG. 2

With reference to FIGS. 1 and 2, a schematic cross section of a fairly typical roll-to-roll feed system of the prior art is shown. It is noted that the printing table 10 is typically about 15 cm long, and has a similar length L to that of the printing head box 12 or carriage, and typically a width of from tens of centimeters to 5 or 6 meters, in accordance with the width of the substrates that can be accommodated. The substrate 14 to be printed is inherently flexible and is supplied on one roll, and is rolled past the printing table onto a second roll. The substrate 14 is threaded between a feed roller 16 and a pressure roller 18 and kept pressed onto the feed roller 16 by the pressure roller 18. The feed roller 16 advances the substrate 14 incrementally in small steps between passes of the printing heads 12 as their carriage moves from side to side along a track (not shown) over the printing table 10. The substrate 14 is fed over a guide roller 20 and around a tension roller 22 which keeps the substrate 14 flat. It will be noted that the feed roller 16 and guiding roller 20 are positioned slightly below the printing table 10. This enables the flexible substrate 14, which may be a fabric or a paper, to be kept taut and flat over the printing table 10; it being appreciated that unless the substrate 14 is kept flat during printing, the resolution and accuracy of the printing is adversely affected.

The feed roller 16 and guiding roller 20 need only be positioned a couple of centimeters below the printing table 10 however. The height of the printing table above the workshop floor should not be too high to impede viewing of the surface of the substrate as it is being printed, which should, therefore, be below eye level. The pressure roller 18 is required to be repositioned below and away from the feed roller 16 to enable passage of the hand so that the substrate 14 can be threaded therebetween. The tensioning roller 22 and the rolls for the roll stock of the substrate are generally positioned therebelow.

Figure 3:
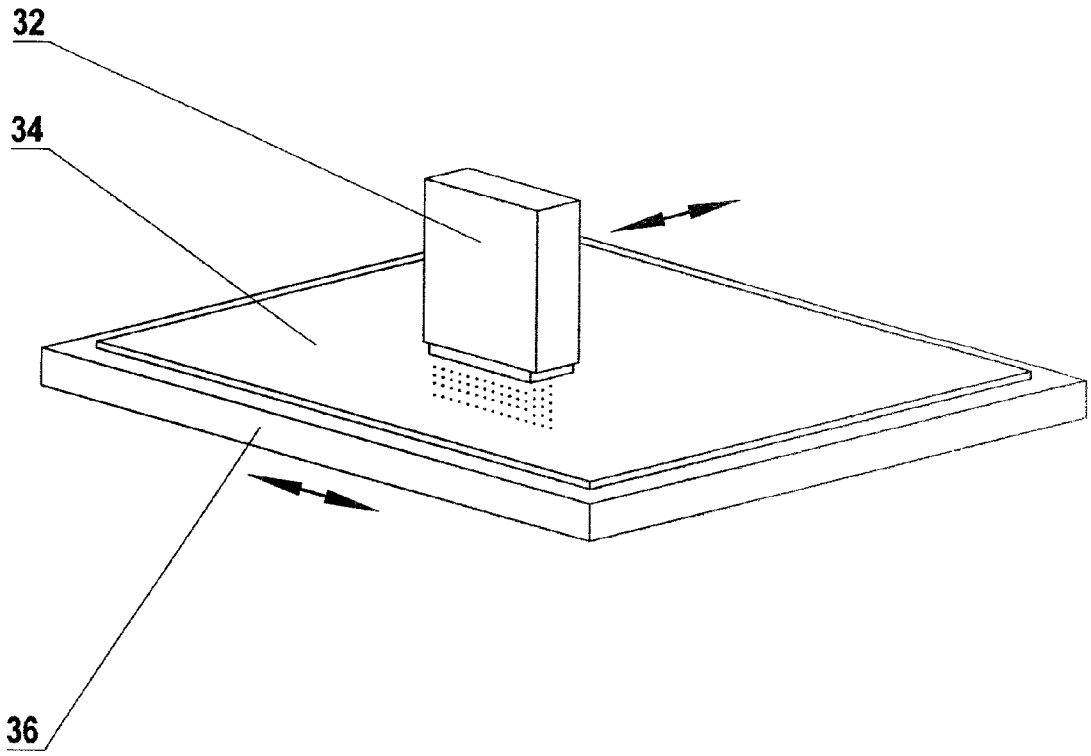
(PRIOR ART) FIG. 3

With reference to FIG. 3, a schematic isometric projection of a prior art flat bed printing system is shown. The printing head box 32 moves from side to side over a long table 36 that may be a vacuum table to securely hold a flat sheet 34 to be printed. The table 36 moves past the printing head box 32, which typically only moves from side to side. Flat bed printing is suitable for printing onto wide or super wide sheets of material, particularly where the material is too thick or stiff to be provided as roll stock.

In contrast with roll to roll printing systems, the length of the flat sheet 34 that can be printed by a flat bed system is determined by the dimensions of the table 36, since movement of the sheet 34 with respect to the table will result in misalignment of the material 34 with respect to the printing head box 32.

Figure 4:
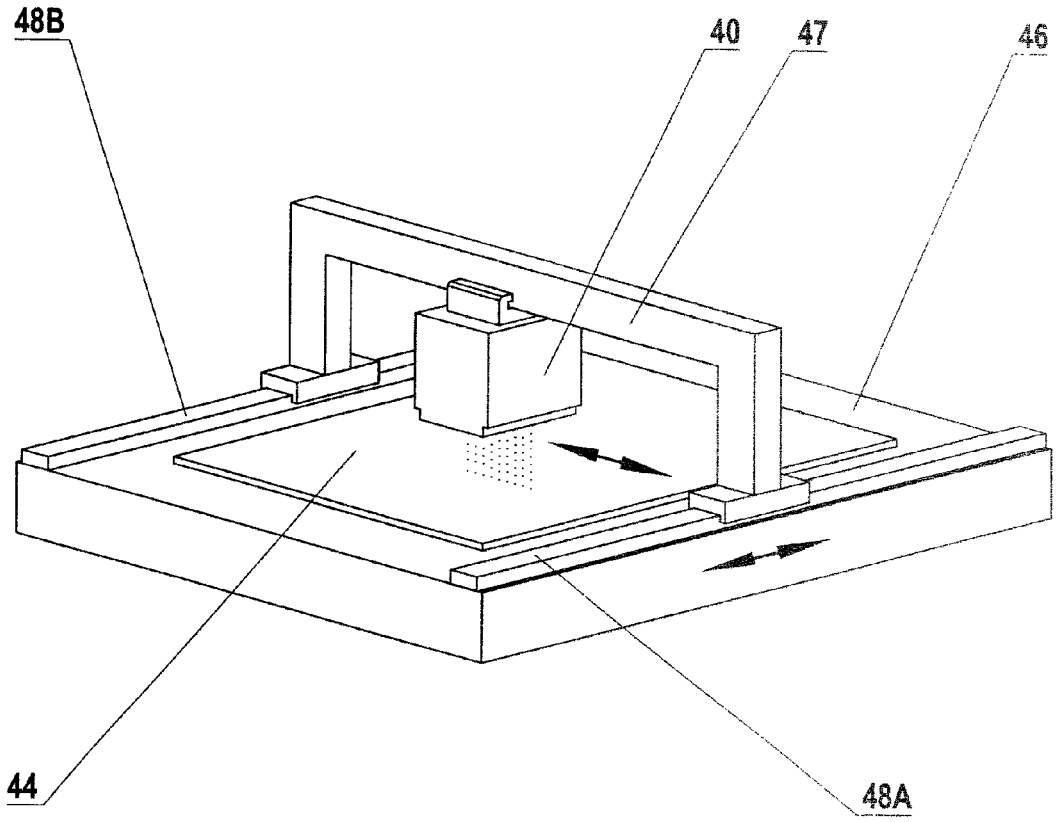
(PRIOR ART) FIG. 4

As shown in FIG. 4, in another type of prior art flat bed printing system, the flat sheet 44 to be printed is rigidly held to the table 46, and the track 47 of the printer head 40 may be advanced down the table 46 on rails 48A, 48B along the edges thereof.

There have been attempts to convert flatbed printers to print onto roll stock, by setting up rollers around a long table designed for flatbed printing onto rigid substrates. This approach does not produce reasonable results when printing onto wide/superwide media, which may be 3 to 6 meters wide, or more. When printing onto such wide substrates, the rollers have to be substantive so as not to bend, and the roll stock substrate to be printed is stretched unevenly and develops a wavy surface. This adversely affects the resolution of the printing thereupon.

The present invention takes an opposite approach and adapts a roll to roll wide/super wide printer having a short printing table, to allow printing onto rigid substrates. Thus a double configuration feed roller system and a wide/super wide digital printer is proposed that can be used for digital printing onto a continuous substrate supplied on a roll, in a roll to roll printing configuration, or onto a flat sheet in a flat substrate printing configuration.

With reference to FIGS. 5 to 8, one embodiment of the digital printer 100 is schematically shown. The double configuration described hereinbelow enables the feed roller 116 and guiding roller 120 to be moved between (i) a lower configuration shown in FIG. 5 wherein the upper part of the feed roller 116 and guiding roller 120 are below the level of the table 110, and (ii) an upper configuration shown in FIG. 6 wherein the feed roller 116 and guiding roller 120 are raised to the height of the table 110 and are collinear therewith.

As shown in schematic cross section in FIG. 5, when configured for roll to roll printing, the feed roller 116 and guiding roller 120 are below the level of the table 110, and the substrate to be printed 114 is stretched over the table 110 and thereby kept taut and ripple free. The spindles 115, 121 of the feed roller 116 and guiding roller 120 are fixedly mounted at each end thereof, onto rockers 122, 124 that are rotatably mounted on axes 126, 128 respectively. Slots 132, 134 are cut through the rockers 122, 124, and pins 136, 138 are fixedly mounted to the support structure 125 to which axes 126, 128 are also fixed.

Figure 5:
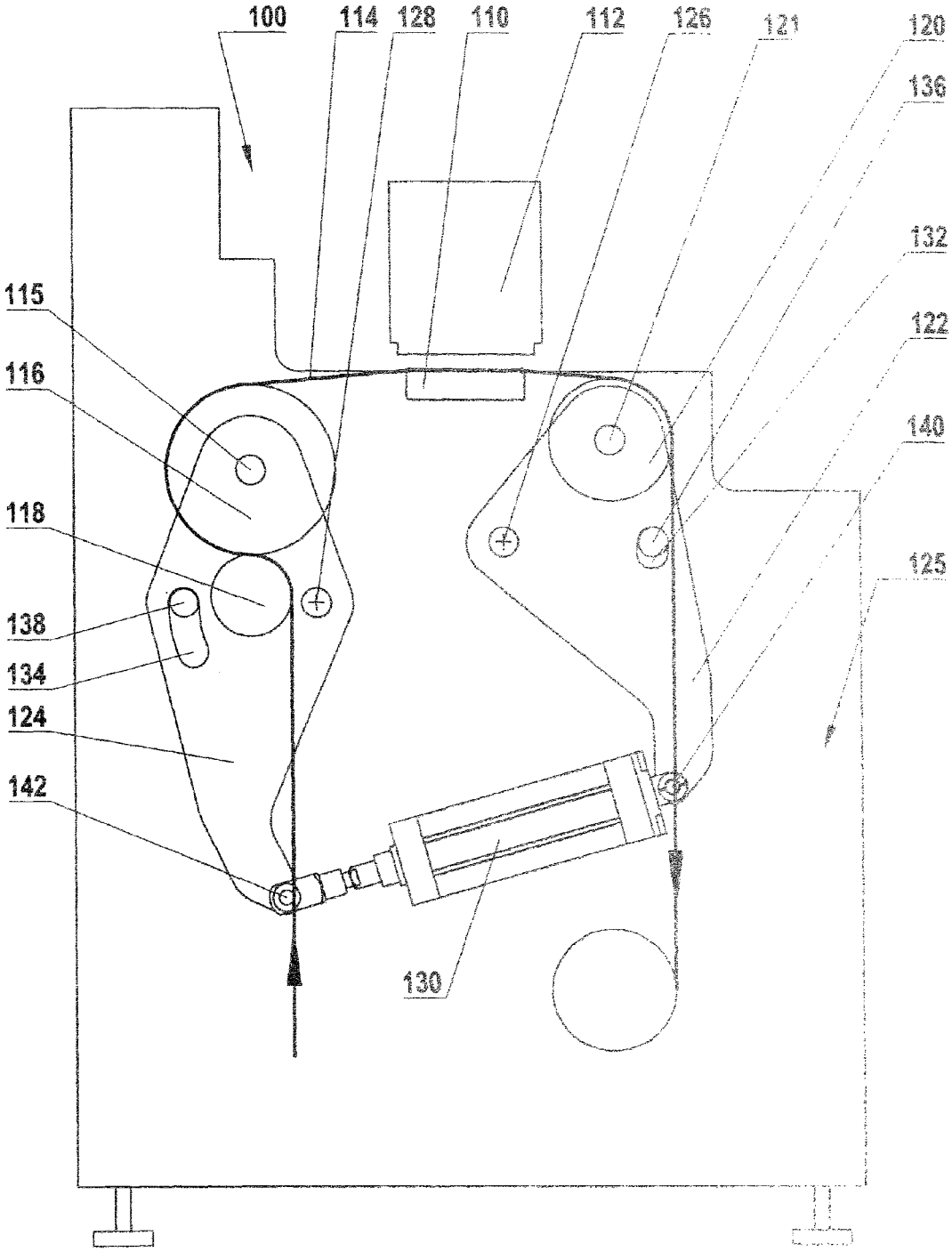

A drive means of variable length, illustrated herein as a piston 130, such as a hydraulic or pneumatic piston, is attached to lower parts 140, 142 of rockers 122, 124, which, in the lower configuration shown in FIG. 5, is kept compressed, thereby pulling lower parts 140, 142 towards each other, and forcing the pins 136, 138 to the top edge of slots 132, 134 in which position, the feed roller 116 and guiding roller 120 are below the level of the table 110, and the substrate to be printed 114, is thereby kept taut and ripple free.

It will be appreciated that other driving means, such as springs, worms, motors and the like (not shown) may be used instead of a piston 130, to give an equivalent movement, driving the feed rollers between the two positions.

Figure 6:
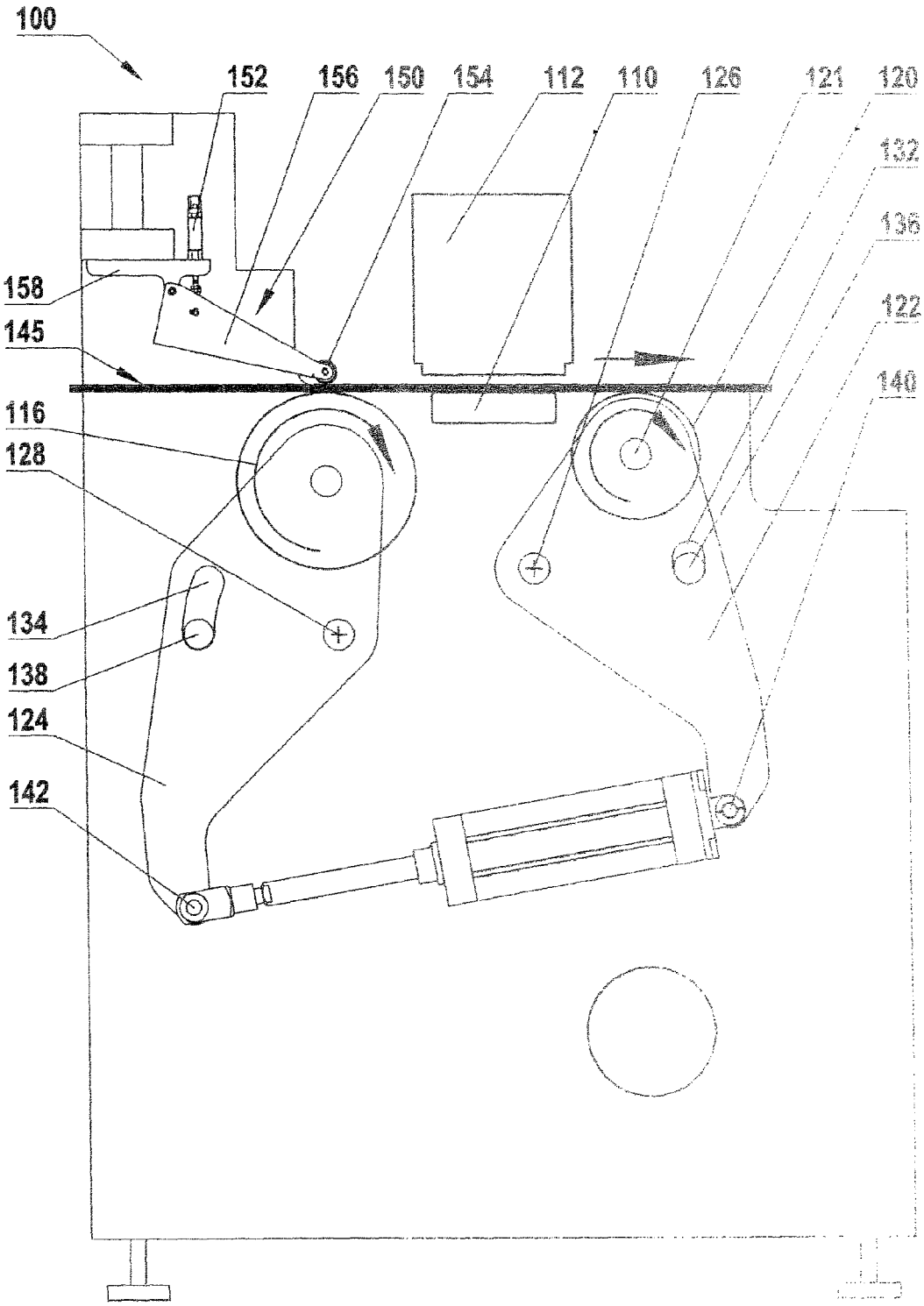

As shown in FIG. 6, to print onto separate sheets of a discontinuous substrate 145, which is typically a less flexible, more rigid, thicker material such as cardboard and the like, the piston is extended. This forces bottom parts 140, 142 of rockers 122, 124 apart, rotating rockers 122, 124 around axes 126, 128, thereby bringing slots 132, 134 upwards around pins 136, 138, so pins 136, 138 contact base of slots 132, 134 and are stopped thereby, preventing further rotation of rockers 122, 124. In this position, the feed roller 116 and guiding roller 120 are at the level of the table 110. A flatbed pressure system 150 is lowered onto the substrate 145 to be printed, pressing the substrate 145 onto the feed roller 116. The flatbed pressure system 150 may be a row of individual idling wheels 154 which are attached to arms 156 that pivot down from a common support 158, each arm 156 being pressed downwards by a pressure means 152, which may be a Hookian element such as a helical spring, or a closed piston, for example. The purpose of the flatbed pressure system 150 is only to keep the discontinuous substrate 145 pressed onto the feed roller 116, ensuring that rotation of the feed roller 150 advances the discontinuous substrate 145 over the table 110 so that it may be printed. In this manner, a feed roller 116 is used for incremental advancing of a discontinuous substrate 145 which may be a rigid or thick discontinuous substrate 145, unsuitable for rolling, or simply a relatively short length of material supplied as roll stock, such as the end of a roll.

As illustrated in FIGS. 5 and 6, the drive means may be a rod in cylinder type piston 130 that can be hydraulically or pneumatically powered. The cylinder can be coupled to the rocker 122 of the guiding wheel 120 and the rod may be coupled to the rocker 124 of the feed roller 116. Alternatively and equivalently, the piston 130 may be reversed with the piston rod being coupled to the rocker 122 of the guiding wheel 120 and the cylinder being coupled to the rocker 124 of the feed roller 116. Furthermore, other driving means such as a worm and/or a motor, for example, might be substituted without exceeding the scope of the invention. In preferred embodiments, a pair of driving means is used on similar rockers; one at each end of the feeding 116 and guiding 120 rollers. This helps ensure accurate, straight feeding of the substrate 114, 145. Strictly speaking however, only one driving means is required.

The feed roller 116 is usually rubber coated to provide a high friction surface. The rollers are rigid by their construction and resist bending. The table 110 often has a square profile and is typically less rigid than the rollers 116, 120. It will be noted that for wide/super wide printing, the width of the table may be several meters. Preferably the table 110 is supported periodically by adjustable supports and the absolute height of the table 110 at each support point may be adjusted to ensure planarity. The rollers 116, 120 may be used as guides for this purpose.

Since the feed roller 116 is moved upwards and forwards when moving from the roll-to-roll lower configuration of FIG. 5 to the flat bed upper configuration of FIG. 6, the feed roller 116 is separated from the pressure roller 120, which is not even shown in FIG. 6 as it plays no part. This separation aids feeding of substrate 114 supplied as roll stock between pressure roller 118 and feed roller 116. In the prior art, the pressure roller 118 is typically lowered to achieve this. In some embodiments of the invention, the pressure roller 118 may still be lowered, but in other embodiments, this is not necessary. Since the height of digital printing machines is effectively limited, and there is a need to accommodate further rolls and rollers, etc. such as the supply roll of the substrate 114 to be printed, and the take up roll for the printed substrate 114, space and height is at a premium, and the fact that the feed roller 116 can be lifted and moved forwards, away from the pressure roller 118, provides additional space between feed roller 116 and pressure roller 118 for feeding the substrate 114 therethrough.

Figure 7:
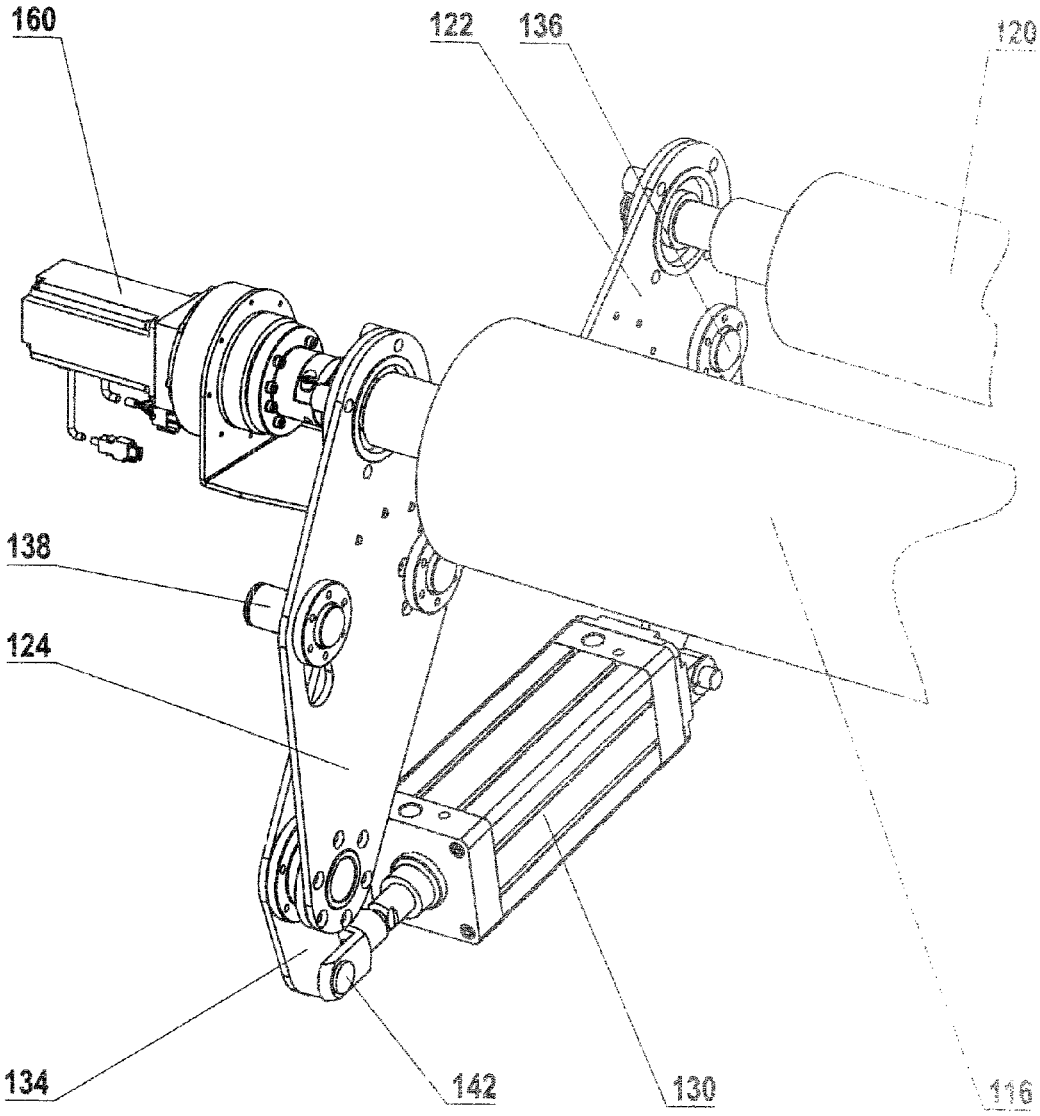

With reference to FIG. 7, the adjustable roller support system, one end of the feed roller 116 and one end of the guiding roller 120 are shown in isometric projection. It will be noted that the motor unit 160 is coupled directly to the spindle 115 of the feed roller 116 which is incrementally advanced in a stepwise fashion thereby. In the embodiment shown, the motor unit 160 is attached to the spindle 115 of the feed roller 116 in a fixed alignment therewith, and moves down and up with the feed roller 116 as the feed roller 116 is moved between its lower and upper configurations as shown in FIG. 5 and FIG. 6 respectively.

Figure 8:
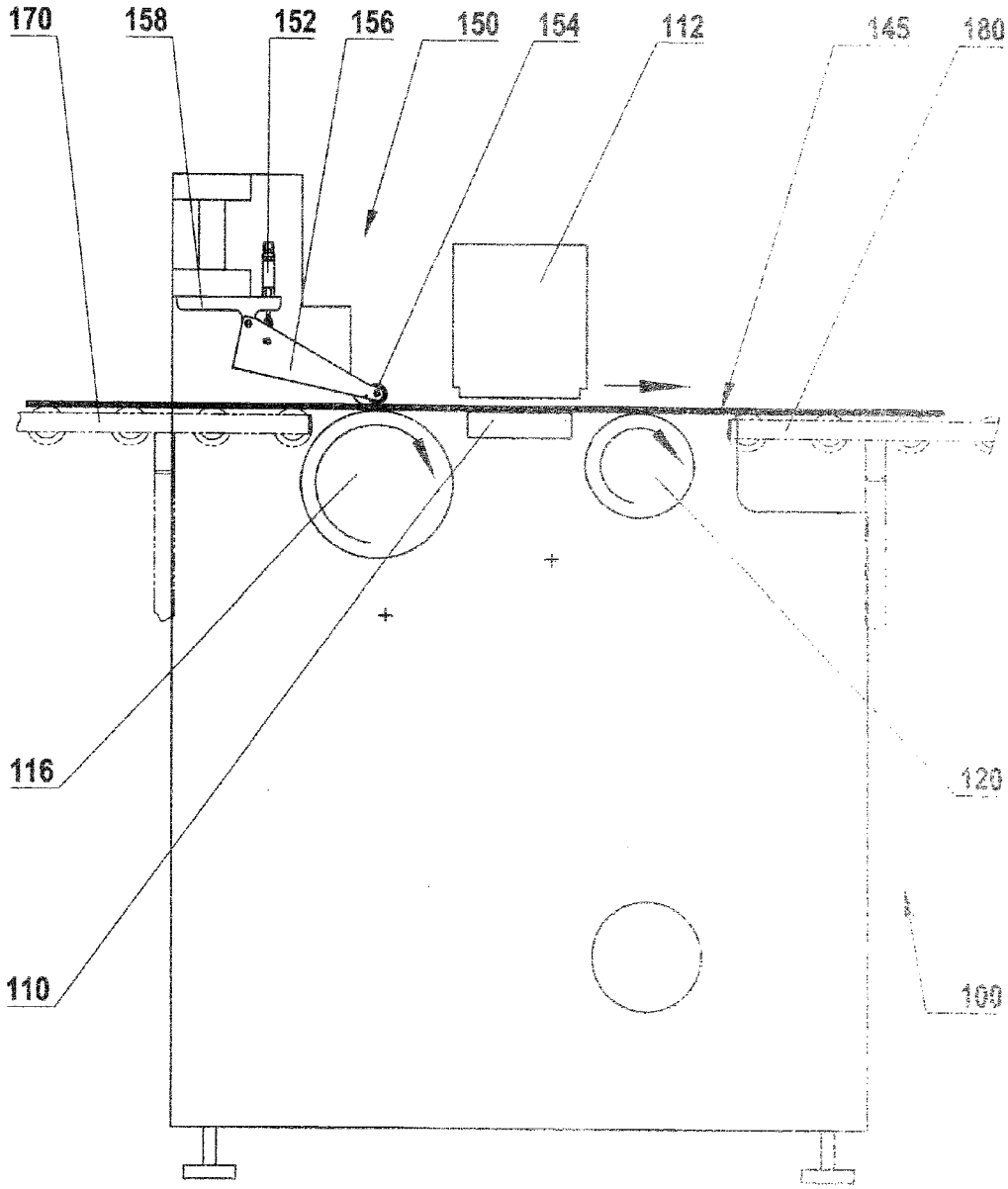

Referring now to FIG. 8, since in the present invention the wide flat bed table previously required has been eliminated, with the substrate 145 to be printed being advanced past the printing head box 112 that moves from side to side along a single track, by a feed roller 116, it is typically necessary to provide external support to a discontinuous sheet substrate 145 to be printed, even if the substrate 145 is fairly thick and rigid. A convenient way to provide such support is to bring a feeder roller table 170 and a collector roller table 180 into proximal alignment with the rollers of the printing unit 100. A rigid laminar substrate 145 to be printed may be placed on feeder roller table 170 with its front edge resting on feed roller 116, and with the flatbed pressure system 150 applying a pressure thereto, to keep the rigid laminar substrate 145 in contact with the feed roller 116. The feed roller 116 is turned in small steps by the motor unit, and the substrate 145 to be printed is incrementally advanced over the printing table 110 onto guiding roller 120 and then onto the collector roller table 180.

Super wide printers may be 3 meters wide or more. Rigidity becomes important for high resolution printing. In contradistinction to the prior art, since the digital printer of the invention uses a feed roller for advancing discontinuous laminar substrates as well as when printing roll to roll, long printing tables are eliminated and a printing table that is not more than 20 cm long is used. One consequence of this is that the length of the machine 100 is typically well under a meter. Nevertheless accurate forwarding of large substrates 145, 114 to be printed is allowed.

The roller tables 170, 180 shown in FIG. 8 are optional, and the substrate 145 to be printed may alternatively be supported in other ways, such as manually supported by workers, for example. Additionally, where provided, roller tables 170, 180 are utility components that may find a wide range of alternative uses other than for supporting discontinuous substrates 145 when using the digital printer 100 of the inventor for flat bed type printing.

Thus persons skilled in the art will appreciate that the present invention is not limited to what has been particularly shown and described hereinabove. Rather the scope of the present invention is defined by the appended claims and includes both combinations and sub combinations of the various features described hereinabove as well as variations and modifications thereof, which would occur to persons skilled in the art upon reading the foregoing description.

In the claims, the word "comprise", and variations thereof such as "comprises", "comprising" and the like indicate that the components or processing steps listed are included, but not generally to the exclusion of other components.

The invention claimed is:

1. A system for raising and lowering a pair of rollers between a raised configuration and a lowered configuration with respect to a fixed support, comprising mounting each of said pair of rollers on a spindle fixed to a rocker on each end, each rocker being movable about an axle fixed to the fixed support, the moving of each rocker between a first position and a second position being driven by a driving means, and the first and second positions being determined by peg in slot mechanisms, wherein each rocker comprises a slot therethrough through which a peg fixed to the fixed support passes, and each rocker can be moved from a first position where the peg contacts the upper edge of the slot and a lower position where the peg contacts the lower edge of the slot.

2. The system of claim 1 wherein the pair of rollers comprises a feed roller and a guiding roller of a digital printer, such that in the raised configuration the feed roller and guiding roller are brought into alignment with an upper surface of a printing table and a rigid and/or discontinuous laminar substrate may be printed by a printer head that travels from side to side across the digital printer over the printing table, whereas in the lowered configuration the feed roller and guiding roller are positioned below the printing table and a flexible substrate may be printed in a roll to roll configuration.

3. The system of claim 2 wherein the feed roller is coated with a high friction rubbery surface.

4. The system of claim 2 wherein the digital printer is a wide/super-wide digital printer having an effective printing width of at least 2.5 m.

5. The system of claim 2 wherein the digital printer is a wide/super-wide digital printer having an effective printing width of at least 3 m.

6. The system of claim 4 wherein the table length of the wide/super wide digital printer is no more than 15% of the effective printing width.

7. The system of claim 2 wherein the digital printer is a wide/super-wide digital printer having an effective printing width of up to 10 m.

8. The system of claim 1 wherein the driving means is selected from the list of pneumatic pistons, hydraulic pistons, springs, motors and worms.

9. The system of claim 2 wherein the printer table is a short printer table having a length of up to 20 cm.

10. The system of claim 2 wherein the feed roller is advanced by a motor that is in fixed alignment with the spindle of the feed roller such that the motor moves up and down with the feed roller as the feed roller is moved between its upper and lower positions.

11. The system of claim 1 wherein the raising and lowering of the pair of rollers between the raised configuration and the lowered configuration with respect to the fixed support takes less than five minutes.

12. The system of claim 1 wherein the raising and lowering of the pair of rollers between the raised configuration and the lowered configuration with respect to the fixed support is actuated with a switch and takes less than one minute.

13. A wide or super wide digital printer comprising a system for raising and lowering a feed roller and a guiding roller between a raised configuration and a lowered configuration with respect to a fixed support, the system comprising a first spindle mount through the feed roller that is coupled to a first rocker at one end and a second rocker at other end, and a second spindle mount through the guiding roller that is coupled to a third rocker at one end and a fourth rocker at other end, each of said rockers being movable about an axle fixed to the fixed support, the moving of each rocker between a first position and a second position being driven by a driving means, and the first and second positions being determined by peg in slot mechanisms, wherein each rocker comprises a slot therethrough through which a peg fixed to the fixed support passes, and each rocker can be moved from a first position where the peg contacts the upper edge of the slot and a lower position where the peg contacts the lower edge of the slot.

* * * * *